US005196890A

United States Patent [19]

Nakayama et al.

[11] Patent Number: 5,196,890

[45] Date of Patent: Mar. 23, 1993

[54] ELECTROSTATIC RECORDING HAVING SWINGABLE RECORDING ELECTRODES TO PREVENT DEPOSIT OF MAGNETIC TONER ON OPPOSITE ELECTRODE

[75] Inventors: Kenji Nakayama, Kodaira; Eiichi Takeuchi; Shigeru Shimizu, both of Iruma; Tadao Yamamoto, Tokyo; Hideaki Inoue, Musashimurayama; Yasuhito Sato, Akishima; Hideki Takahashi, Fussa; Toshiro Honda, Mitaka; Kenichiro Asako, Kokubunji, all of Japan

[73] Assignee: Casio Computer Co., Ltd., Tokyo, Japan

[21] Appl. No.: 784,999

[22] Filed: Oct. 30, 1991

[30] Foreign Application Priority Data

Nov. 29, 1990 [JP] Japan ..... 2-334566
Nov. 30, 1990 [JP] Japan ..... 2-334535

[51] Int. Cl.[5] ..... G03G 21/00

[52] U.S. Cl. ..... 355/259; 118/657; 355/245; 355/251

[58] Field of Search ..... 355/245, 246, 259, 261, 355/262, 251, 253; 118/651, 661, 656, 657; 430/35, 36, 37

[56] References Cited

FOREIGN PATENT DOCUMENTS 0049141 4/1979 Japan ..... 355/261
0121362 7/1984 Japan ..... 355/262
0136775 7/1985 Japan ..... 355/261
0121863 5/1988 Japan ..... 355/262
0174081 7/1988 Japan ..... 355/261
0068770 3/1989 Japan ..... 355/261

*Primary Examiner*—A. T. Grimley
*Assistant Examiner*—T. A. Dang
*Attorney, Agent, or Firm*—Nixon & Vanderhye

[57] ABSTRACT

An electrostatic recording apparatus includes a developing agent carrier member arranged along a predetermined developing agent convey path. A developing agent conveying section conveys a developing agent along a surface of the developing agent carrier member. A plurality of recording electrodes are arranged on the surface of the developing agent carrier member at a predetermined pitch. An opposite electrode is arranged to oppose the plurality of recording electrodes at a predetermined gap. A voltage applying section applies a voltage corresponding to recording information to each of the plurality of recording electrodes to selectively transfer the developing agent, which is conveyed along the surface of the developing agent carrier member, to the opposite electrode. The developing agent carrier member has a step at a portion on its surface shifted to an upstream side of a developing agent convey direction from a position closest to the opposite electrode. At least distal end portions of the plurality of recording electrodes project from this step toward the closest position to form projections. The projections are swingable in a direction of approaching or going away from the opposite electrode.

9 Claims, 11 Drawing Sheets

ELECTROSTATIC RECORDING HAVING SWINGABLE RECORDING ELECTRODES TO PREVENT DEPOSIT OF MAGNETIC TONER ON OPPOSITE ELECTRODE

BACKGROUND OF THE INVENTION

1. Field of the Invention

The present invention relates to a noncontacting electrostatic recording apparatus for forming an electrostatic recording image without bringing a recording head and a recording medium into contact with each other.

2. Description of the Related Art

A multistylus printer is conventionally well known as an electrostatic recording apparatus. This multistylus printer has a recording head constituted by arranging a large number of needle-like electrodes (styluses) in a main scanning direction with equal small intervals therebetween and selectively applies a voltage to each needle-like electrode in accordance with a recording signal to directly perform discharging on paper, thereby forming an electrostatic latent image. In this printer, in order to easily and stably hold an electric charge on paper, specialty paper coated with a high electrical resistance agent is used. Specialty paper of this type, however, is difficult to write something on it with a pen or a pencil and has a problem in storage stability because it is denatured depending on environmental conditions such as a humidity. Therefore, this specialty paper is not preferred as office paper.

In addition, when a gap between the distal end of each needle-like electrode and the surface of paper is large, a discharge electric field from the needle-like electrodes is widened on the paper surface to increase the size of formed dots, thereby making it difficult to obtain a high-resolution recording image. Therefore, a gap material is provided on the paper surface and brought into slidable contact with the distal ends of the needle-like electrodes to ensure a small gap. However, this system has a problem in that the distal ends of the needle-like electrodes are abraded or worn down.

Therefore, as an electrostatic recording system capable of using plain paper and ensuring a small gap between an image medium and the distal ends of recording electrodes, there is a system for forming a toner image on a drum-like intermediate recording medium and transferring the toner image on paper. According to this system, since the size of an apparatus tends to be increased due to the use of an intermediate recording medium, a process of simultaneously performing recording and development is often adopted to avoid the increase in apparatus size. In this case, mostly, a large number of recording electrodes ar aligned in the widthwise direction (main scanning direction) of a developing agent convey path, and a developing agent is selectively transferred from the recording electrodes to the surface of an opposite electrode also serving as an intermediate recording medium in accordance with recording information, thereby developing a toner recording image consisting of dots. In this system, the electrode gaps between the recording electrodes and the opposite electrode must be constant throughout the widthwise direction of the developing agent convey path.

The opposite electrode usually forms a drum and is rotated in order to serve also as a recording medium. In this case, when the opposite electrode is rotated, its circumferential surface tends to swing in the axis or circumferential direction. For this reason, the electrode gap can become locally narrow. When the developing agent is supplied to the narrow electrode gap, the density of the developing agent is increased, and the developing agent becomes dense between the electrodes under pressure. As a result, the electrical resistance of the developing agent, which is normally about $1\times10^{11}$ [Ω], is decreased to $1\times10^{3}$ to $1\times10^{6}$ [Ω] at the dense portion. A large current flows in this portion to generate heat, and the developing agent is fused onto the electrodes by the heat and the filling pressure, leading to a serious trouble. When the developing agent is fused on the electrodes, the image resolution is decreased, and the image contrast or visibility is degraded.

When the gap between the recording electrodes and the opposite electrode is increased as the result of swing, the electrical field is widened to cause a problem in that a high-resolution recording image cannot be obtained

SUMMARY OF THE INVENTION

It is, therefore, an object of the present invention to provide an electrostatic recording apparatus which can form a high-resolution, high-quality recording image by maintaining a gap between recording electrodes and an opposite electrode at constant value.

In order to achieve this object, the electrostatic recording apparatus according to the present invention comprises

- a developing agent carrier member having a surface and arranged along a predetermined developing agent convey path,
- developing agent conveying means for conveying a developing agent along the surface of the developing agent carrier member,
- a plurality of recording electrodes arranged on the surface of the developing agent carrier member at a predetermined pitch,
- an opposite electrode arranged to oppose the plurality of recording electrodes at a predetermined gap, and
- voltage applying means for applying a voltage corresponding to recording information to each of the plurality of recording electrodes to selectively transfer the developing agent, which is conveyed along the surface of the developing agent carrier member, to the opposite electrode, thereby forming a recording image corresponding to the recording information on the opposite electrode,
- wherein the developing agent carrier member has a step at a portion on the surface thereof shifted from a position closest to the opposite electrode to an upstream side of a developing agent convey direction, at least distal end portions of the plurality of recording electrodes project from the step toward the closest position to form projections, and the projections are swingable in a direction of approaching or going away from the opposite electrode.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention will be described in detail below with reference to the accompanying drawings.

Figure 1:
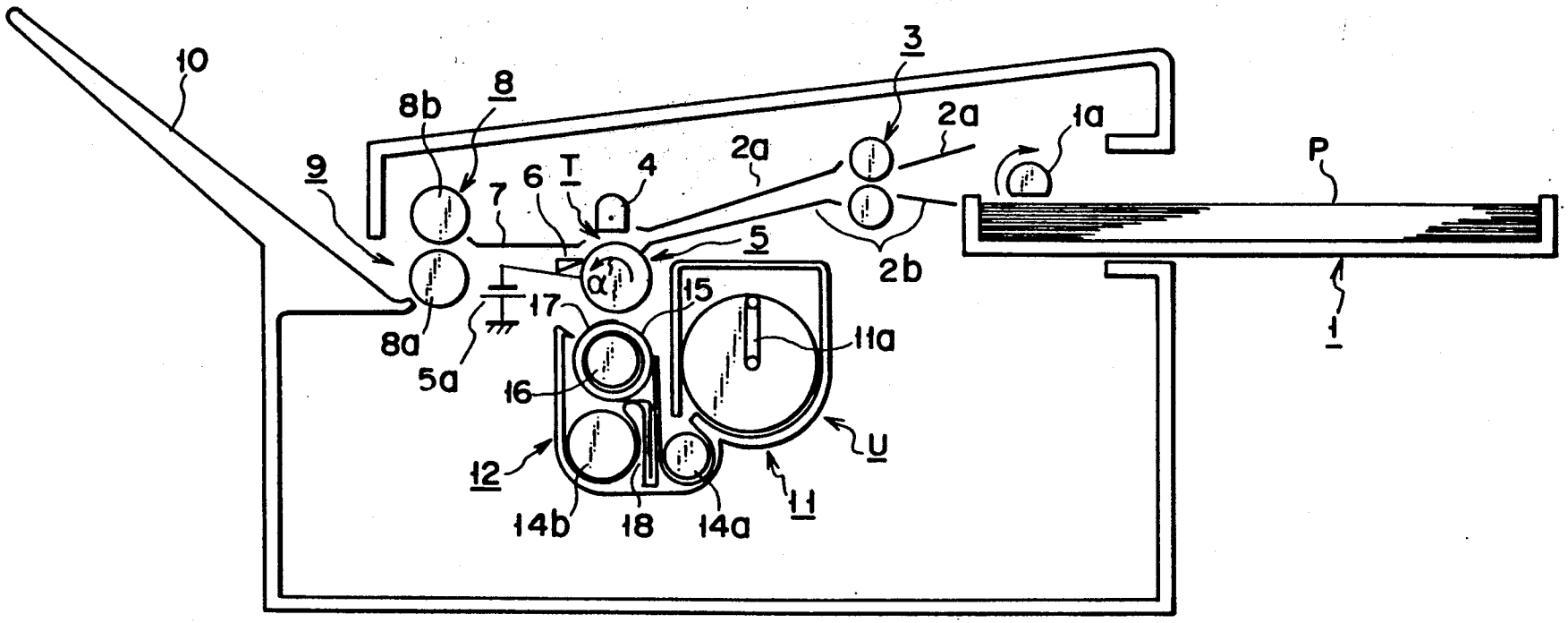
FIG. 1 is a schematic sectional view showing an overall arrangement of an electrostatic recording apparatus according to the present invention.

FIG. 1 is a schematic sectional view showing the overall arrangement of a recording apparatus as the first embodiment of the present invention. Referring to FIG. 1, reference numeral 1 denotes a paper feed cassette in which sheets of plain paper P are stacked and which is detachably mounted on a side portion of the apparatus. A paper feed roller 1*a* is arranged above the front end portion of the paper feed cassette 1 inserted in the apparatus so as to be rotatable in a direction indicated by an arrow. In front of the paper feed roller 1*a*, upper and lower guide plates 2*a* and 2*b* each consisting of an insulating member are arranged to form a paper convey path. A registration roll pair 3 is arranged in the paper convey path to temporarily stop conveyance of the paper P fed by the paper feed roller 1*a*, thereby adjusting the paper posture. Thereafter, the registration roll pair 3 feeds the paper again to an image transfer section T on the downstream side in synchronism with an arrival timing of a recording image (to be described later).

In the image transfer section T on the down-stream side of the registration roll pair 3, a transfer charger 4 is arranged to oppose a cylindrical electrode 5 as an opposite electrode also serving as an image carrier. In this embodiment, the cylindrical electrode 5 is rotated counterclockwise as indicated by an arrow $\alpha$. A recording image forming unit U (to be described later) is arranged to oppose the circumferential surface of the cylindrical electrode 5 on the opposite side of the transfer charger 4. A toner recording image is formed on the surface of the cylindrical electrode 5 by the recording image forming unit U, conveyed to the image transfer section T by the rotation of the cylindrical electrode 5, and transferred onto paper fed again. The arrangement of the recording image forming unit U will be described in detail later.

On the downstream side of the image transfer section T, a separating claw 6 is arranged such that its distal end is urged against the circumferential surface of the cylindrical electrode. On the downstream side of the separating claw 6, an air-suction type conveyor belt 7 is horizontally arranged to convey paper separated from the surface of the cylindrical electrode 5 to a fixing unit 8 arranged before the conveyor belt 7 while chucking the rear surface of the paper separated from the circumferential surface of the cylindrical electrode 5 by the separating claw 6 after the image transfer. The fixing unit 8 is constituted by a heat roll 8*a* and a pressure roll 8*b* and thermally fixes the toner image while the paper is conveyed between the two rolls. The paper subjected to fixing is exhausted from an exhaust port 9 and stacked on a paper exhaust tray 10 in a face-down state in that the image surface faces down.

In the recording apparatus of this embodiment as described above, since the entire paper convey path from paper feed to paper exhaust is formed substantially straight, a paper conveying operation is generally smooth to prevent easy occurrence of an image defect or a paper conveyance defect such as jamming. In addition, this recording apparatus has another advantage in that a face-down paper exhaust state not requiring page sorting desirable in a recording apparatus is obtained by the above straight paper convey path.

The arrangement of the recording image forming unit U will be described in detail below.

Figure 2:
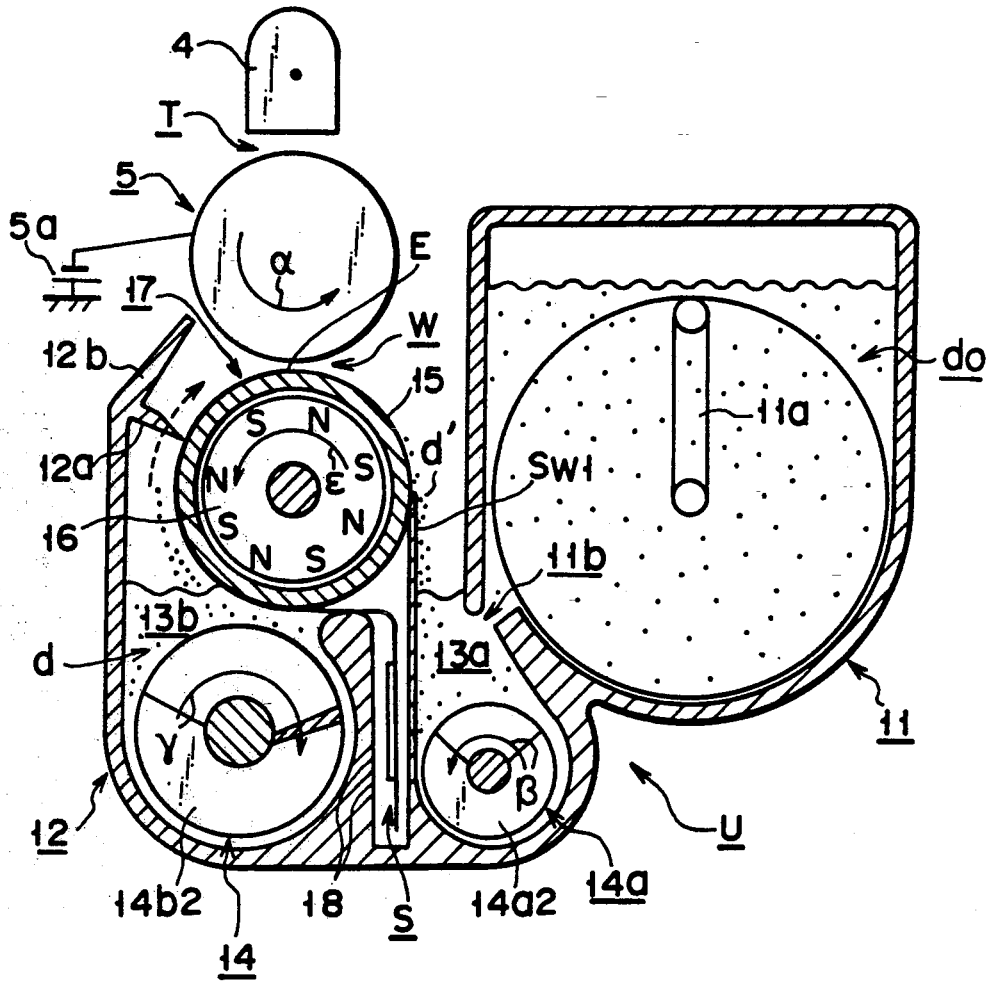
FIG. 2 is an enlarged sectional view showing a recording image forming unit and its peripheral arrangement shown in FIG. 1.

As shown in FIG. 2, the recording image forming unit U generally comprises a developing/recording tank 12 having a recording means and a developing agent conveying means, and a developing agent storage tank 11 for storing a developing agent for replenishment. An agitating blade 11*a* is pivotally arranged in the developing agent storage tank 11. In this embodiment, a one-component developing agent containing at least an insulating resin, a magnetic fine powder, and coloring agent particles is used as a developing agent, and an insulating magnetic toner having a negative (−) triboelectrification polarity is contained. A two-component developing agent obtained by mixing a magnetic carrier and an insulating toner at a predetermined ratio may also be used as a developing agent.

Figure 3:
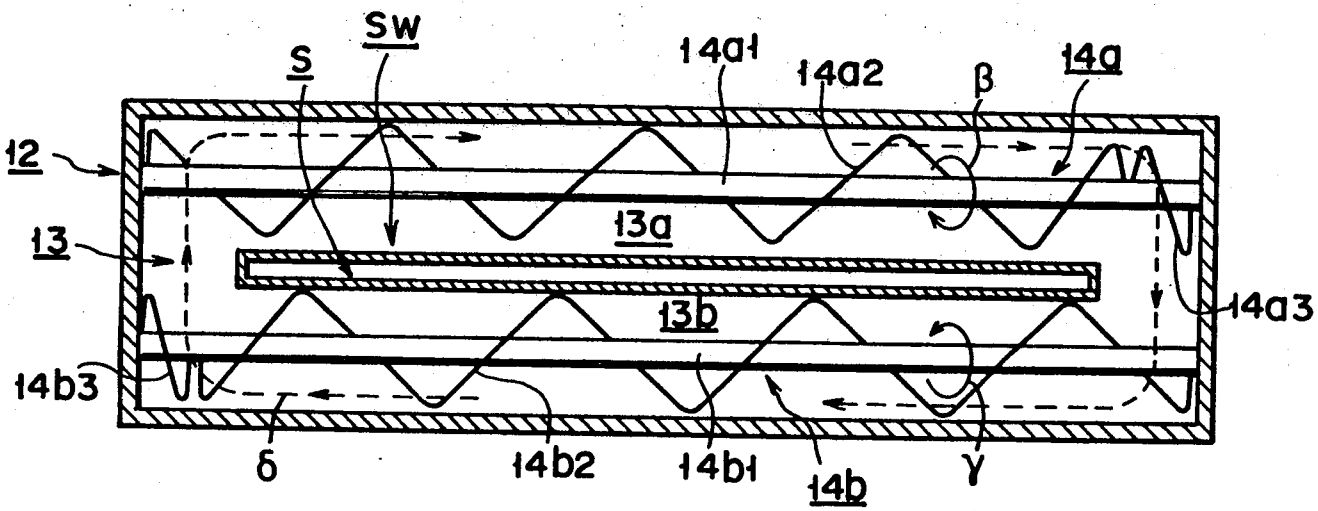
FIG. 3 is a plan sectional view showing a horizontal circulating path for a developing agent in the recording image forming unit shown in FIG. 1.

A horizontal circulating path 13 for a developing agent shown in FIG. 3 is formed on the bottom portion of the development/recording tank 12. Referring to FIG. 3, a pair of auger rolls 14*a* and 14*b* are rotatably arranged in a pair of parallel longitudinal paths 13*a* and 13*b* of the horizontal circulating path 13. The auger rolls 14*a* and 14*b* are constituted by forming a plurality of spiral blades 14*a* 2 and 14*b*2 on the circumferential surfaces of shafts 14*a* 1 and 14*b*1 and forming reverse feed blades 14*a* 3 and 14*b*3 having opposite spiral directions each on one end portion of a corresponding shaft (see the perspective view in FIG. 5). The auger rolls 14*a* and 14*b* are arranged in the longitudinal paths 13*a* and 13*b*, respectively, such that the reverse feed blades 14*a*3 and 14*b*3 are located on opposite sides. The pair of auger rolls 14*a* and 14*b* are rotated in opposite directions indicated by arrows $\beta$ and $\gamma$ along which a developing agent is conveyed toward the respective reverse feed blades 14a3 and 14b3. As a result, at the corner portions having the reverse feed blades 14a3 and 14b3, reverse conveying forces in opposite directions collide against each other to push the magnetic toner in a perpendicular direction to flow into the other longitudinal path. In this manner, the magnetic toner can be satisfactorily triboelectrified while being circulated under agitation in a direction indicated by a broken arrow $\delta$. A necessary charge amount of a developing agent can be satisfactorily obtained by triboelectrification by changing the shape or material of the auger rolls 14a and 14b.

A space S surrounded by a wall Sw to prevent ingress of the circulating developing agent is formed in a central portion of the horizontal circulating path 13 having the above arrangement. As shown in FIG. 2, above the auger roll 14a closer to the developing agent storage tank 11, a replenishment port 11b of replenishing magnetic toner d0 is formed along the axial direction of the auger roll 14a .

A development sleeve 15 for vertically conveying the developing agent is horizontally arranged above the other auger roll 14b. The developing sleeve 15, which incorporates a rotary magnet roll 16, is arranged to oppose the cylindrical electrode 5 described above. Opposite magnetic poles are alternately formed on the peripheral surface of the magnet roll 16. When the magnet roll 16 is rotated counterclockwise as indicated by an arrow $\epsilon$, the magnetic toner d is conveyed clockwise as indicated by a broken arrow $\zeta$ along the circumferential surface of the developing sleeve 15.

A doctor blade 12a for regulating the layer thickness of the magnetic toner d to be a proper value is arranged near the surface of the developing sleeve 15 serving as a developing agent convey path and on the upstream side in the developing agent conveying direction $\zeta$. A toner scattering preventing plate 12b is arranged above the doctor blade 12a. The toner scattering preventing plate 12b prevents inconvenience in that a developing agent conveyed onto the downstream side due to the layer thickness regulation by the doctor blade 12a is scattered outside the recording/image forming unit U to contaminate an image. In this embodiment, the upper end portion of the tank wall of the developing/recording tank 12 is branched into two parts, the doctor blade 12a is formed in one branch, and the toner scattering preventing plate 12b is formed in the other.

A recording section W for forming a toner recording image is arranged as follows on the circumferential surface of the cylindrical electrode 5 on the downstream side of the toner layer thickness regulating section along the toner conveying direction $\zeta$.

Figure 4:
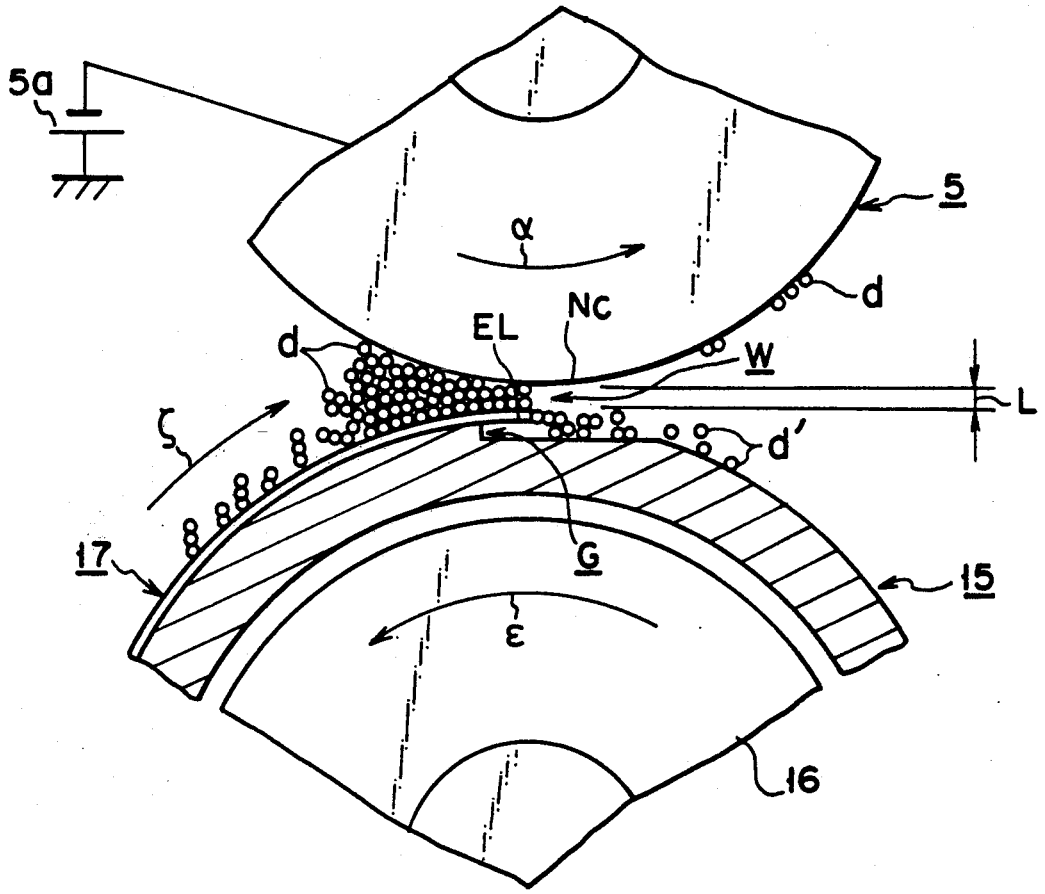
FIG. 4 is a schematic sectional view showing a recording section of an electrostatic recording apparatus according to the first embodiment of the present invention.

As shown in FIG. 4, in the embodiment, a step G is formed at a portion on the developing sleeve 15 which is an upstream position from a position Nc of the circumferential surface of the cylindrical electrode 5 closest to the developing sleeve 15 in the toner conveying direction $\zeta$. The size (height) of the step G is preferably about ten times a distance L between the surfaces of recording electrodes EL (to be described later) and the circumferential surface of the cylindrical electrode 5. In this embodiment, the step G having such a height is formed throughout the entire width of the circumferential surface of the development sleeve. 15.

Figure 5:
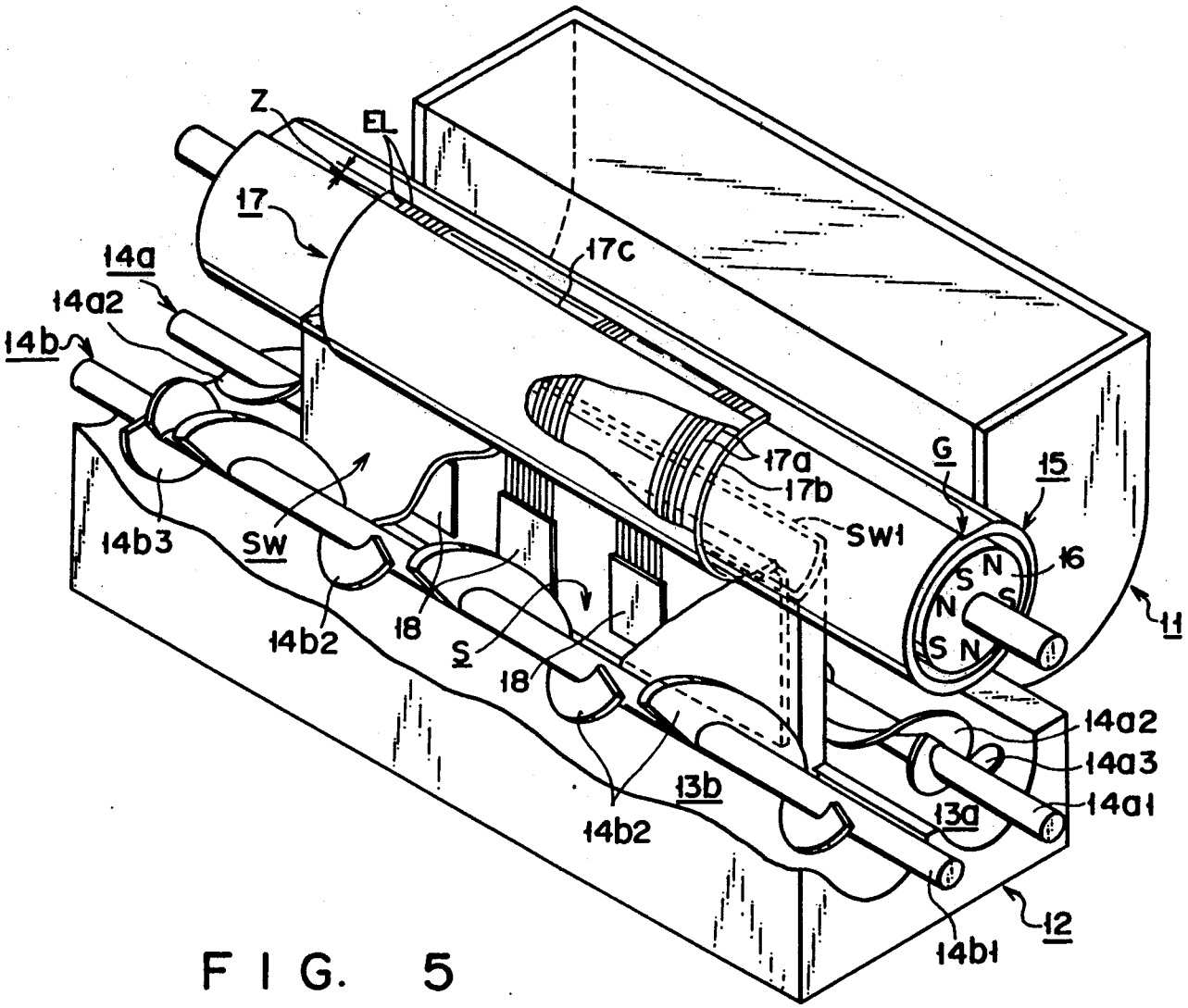
FIG. 5 is a perspective view showing the entire recording image forming unit shown in FIG. 1.

A recording electrode sheet 17 having a large number of recording electrodes is bonded on the circumferential surface of the development sleeve 15 on the upstream side from the step G described above. The recording electrode sheet 17 of this embodiment is constituted by a flexible printed circuit board (FPC). As shown in FIG. 5, in the recording electrode sheet 17, a large number of parallel recording electrode lines 17a extending in the longitudinal direction of the sheet along the circumferential direction o the surface of the development sleeve 15 are arranged with a predetermined small pitch in the widthwise direction of the toner convey path: the main scanning direction). The number f recording electrodes lines 17a is set to correspond to the maximum data number of one main scanning line. In this embodiment, a large number of recording electrode lines 17a consisting of a nonmagnetic conductive material are patterned at a density of 84.6 $\mu$m pitch (300 DPI) with intervals of 40 $\mu$m therebetween.

An insulating coat 17c is coated on the surface of the recording electrode sheet 17 except for a region Z at the end of the sheet contributing to recording image formation. The insulating coat 17c is not coated on the leading end region Z of the recording electrode sheet 17 for the following reason.

That is, a toner recording image is formed by applying a recording voltage corresponding to recording data to the recording electrode lines 17a to form an electric field between the recording electrode lines 17a and the cylindrical electrode 5 and selectively transferring the toner charged by this electric field force to the cylindrical electrode 5, as will be described later. If, however the insulating coat 17c is coated on the surface of the recording electrode lines 17a to be applied with the recording voltage, not only a necessary electric field cannot be efficiently formed, but also an unnecessary electric charge is stored in the insulating coat 17c to lead to image defects such as background smearing or image contamination. Therefore, as shown in FIG. 5, the distal end regions Z of the recording electrode sheet 17 that contribute to toner recording image formation are set as the recording electrodes EL, the insulating coat 17c is not coated on these regions Z, and the recording electrode lines 17a are exposed. As a result, the necessary electric field can be efficiently formed. In addition, since the unnecessary electric charge is not stored, occurrence of image defects such as background smearing caused by the unnecessary electric charge can be reliably prevented.

The recording electrode sheet 17 having the above arrangement is formed on the circumferential surface of the development sleeve 15 such that its distal end portion uniformly projects downstream from the step G with its entire width. The distal end portions of the recording electrode lines 17a on the distal end projection of the recording electrode sheet 17, on which no insulating coat is applied, serve as the recording electrodes EL for forming a recording image. In this embodiment, as shown in FIG. 4, the recording electrode sheet 17 is arranged such that the distal ends of the recording electrodes EL are located immediately below the closest position Nc on the circumferential surface of the cylindrical electrode 5.

Figure 6A:
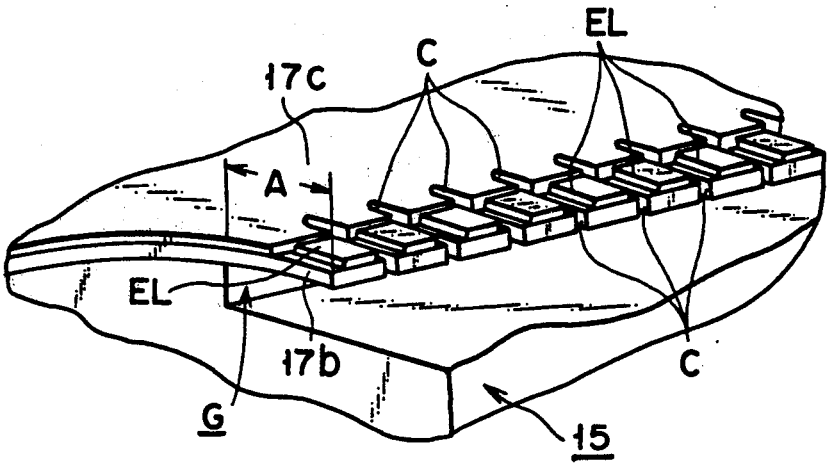
FIGS. 6A and 6B are a perspective view and a plan view, each showing an image forming unit according to the first embodiment of the present invention.
Figure 6B:
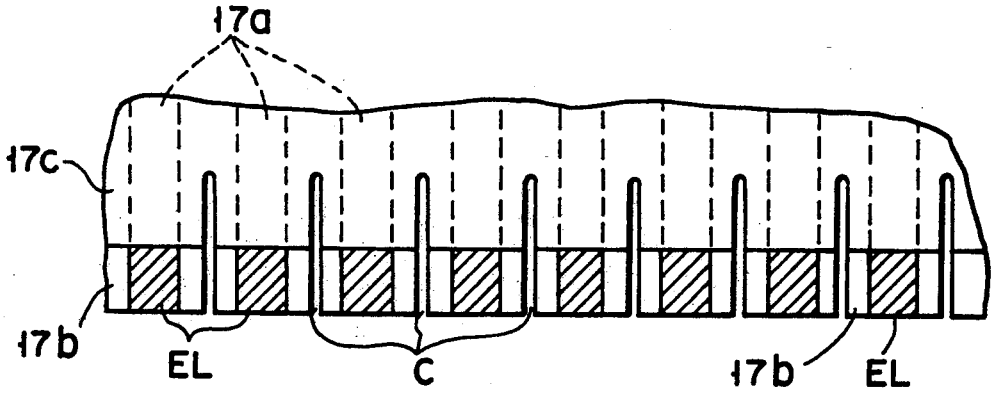

As shown in the perspective view of FIG. 6A and the plan view of FIG. 6B, slits C are formed in the base film 17b at portions between the adjacent recording electrodes EL. Each slit C extends not only between the adjacent recording electrodes EL but also to a portion of the base film 17b covered with the insulating coat 17c. Therefore, each recording electrode EL is separated from the adjacent recording electrodes EL on its two sides and can freely, independently swing in the direction of its thickness (direction of approaching or going away from the cylindrical electrode 5, i.e., vertical direction in this embodiment). In this case, in order to prevent each recording electrode EL from bending downward by its weight while imparting a necessary flexibility (damping function; to be described later) to it, a projecting size A of the recording electrode sheet 17 may be set to about 0 to 2.0 mm.

Figure 7A:
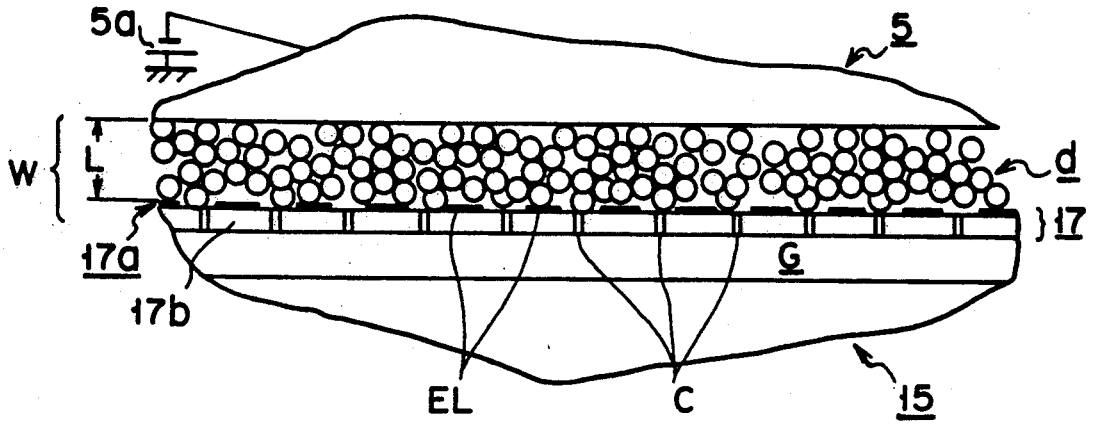
FIGS. 7A and 7B are schematic elevations for explaining an operation of the recording section according to the first embodiment of the present invention.
Figure 7B:
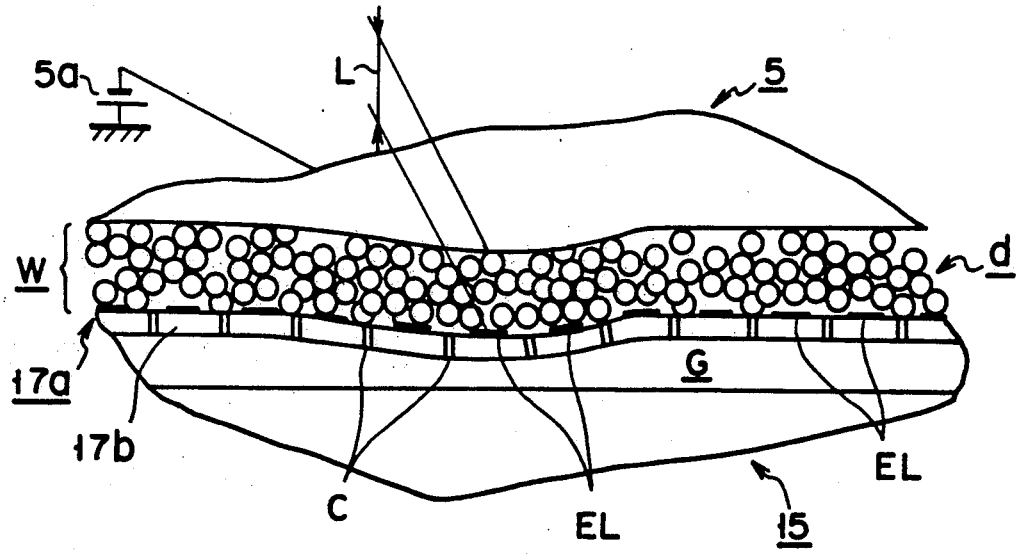

When the recording section W is arranged in the above manner, the distance L (shown in FIG. 7A) between upper surfaces of the recording electrodes EL and the circumferential surface of the cylindrical electrode 5 can be constantly set at a predetermined necessary minimum value. The mechanism for this will be described with reference to FIGS. 7A and 7B. FIGS. 7A and 7B are schematic elevations of the recording section W seen from the downstream side of the toner conveying direction.

As shown in FIG. 7B, during rotation of the cylindrical electrode 5, even if its circumferential surface locally swings to close to the recording electrode EL side by about several μm to several tens of μm, a recording electrode EL opposing to it through the magnetic toner d flexes toward the bottom of the step G, and the electrode-to-electrode distance L is kept at substantially the same as the necessary distance shown in FIG. 7A. Therefore, an inconvenience in that the magnetic toner d becomes excessively dense at the swing portion under pressure is reliably prevented. As a result, an excessive current will not flow in the dense magnetic toner to generate heat, causing magnetic toner fusing to an electrode. The magnetic toner d is smoothly conveyed in the entire width of the counter-electrode portion (the recording section W), and a high-resolution, high-quality recording image can be stably formed.

Figure 8:
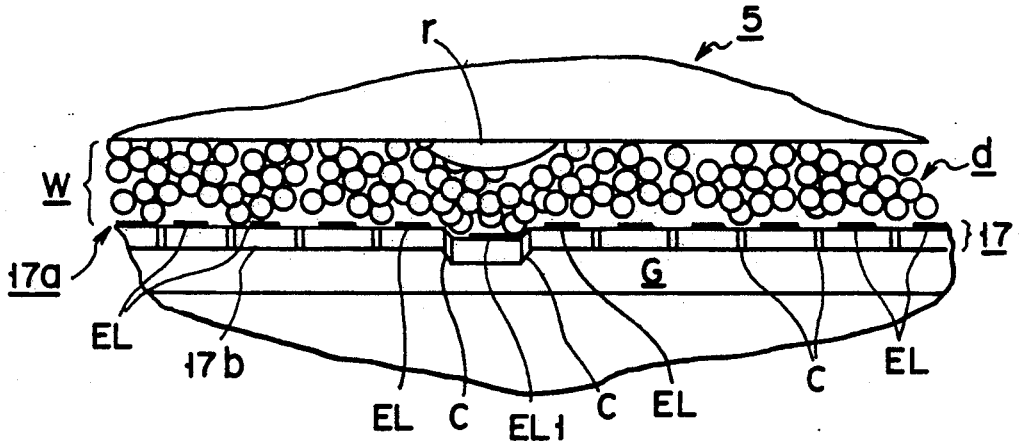
FIG. 8 is a schematic elevation for explaining an operation of the recording section according to the first embodiment under different conditions.

As shown in FIG. 8, even when a foreign substance r mixed in the magnetic toner d or a block of the magnetic toner d is conveyed to the counter-electrode portion (the recording section W), since a recording electrode EL1 that sandwiches the foreign substance r together with the cylindrical electrode 5 is separated from the adjacent recording electrodes EL at its two sides by the slits C, the recording electrode EL1 can locally largely flex independently of the adjacent recording electrodes EL and pass the foreign substance r. In this manner, an inconvenience in that a solid substance such as a foreign substance clogs in the recording section W is reliably prevented, and a high-quality recording image can be formed further stably.

In the manufacture of the recording electrode sheet 17, a base film 17*b*, consisting of a flexible insulating material and coated with a copper foil, is etched to form a pattern of a large number of recording electrode lines 17*a*, the insulating coat 17*c* is coated on the resultant sheet except for the leading end region Z to form the recording electrodes EL, and the slits C are formed between the adjacent recording electrode EL.

Referring to FIG. 2, on the downstream side of the recording section W along the toner conveying direction ζ, a wall Sw1 on the developing agent storage tank 11 side is extended as the wall surrounding the central space S of the above-mentioned horizontal circulating path 13 so that the distal end of the wall Sw1 abuts against the circumferential surface of the development sleeve 15. As a result, a magnetic toner d', which is not transferred in the recording section W but remains on the surface of the development sleeve 15 and is conveyed upon rotation of the magnet roll 16, is scraped on a replenishment tank-side path 13*a* of the horizontal circulating path 13. That is, the magnetic toner d' is prevented from entering the central space S or being returned not via the horizontal circulating path 13 but directly to the upstream side along the circumferential surface of the development sleeve 15. Note that an exclusive plate member for scraping the residual magnetic toner d' deposited on the development sleeve 15 may be prepared independently of the wall of the central space S. In this case, the scraping member is vertically supported such that its distal end abuts against the circumferential surface of the development sleeve 15 and its proximal end extends to the bottom portion of the central space S. When the scraping member is formed of a magnetic material, a smoother scraping-/returning effect can be obtained because the magnetic force of the magnet roll 16 can be interrupted.

As described above, the recording electrode sheet 17 having the recording electrodes EL on its distal end extends on about a half of the circumferential surface of the development sleeve 15 and then extends vertically downward into the central space S of the horizontal circulating path described above. A plurality of driving circuit elements 18 for applying a recording voltage on the respective recording electrodes EL in correspondence with recording data are mounted on the vertically extending portion of the recording electrode sheet 17. As shown in FIG. 5, N recording electrode lines 17*a* of the recording electrode sheet 17 are connected to each driving circuit element 18. In this manner, since the end portion of the recording electrode sheet 17 mounting the driving circuit elements 18 is housed in the central space S, the driving circuit elements 18 can be protected from dust such as a developing agent, and the structure of the developing/recording tank 12 can be made significantly compact.

A recording image forming operation of the electrostatic recording apparatus of this embodiment will be described below.

In FIG. 2, when the magnet roll 16 is rotated in the direction indicated by the arrow ε, a rotational magnetic field for rotating particles of the magnetic toner d is formed on the circumferential surface of the development sleeve 15, and the magnetic toner d is conveyed in the direction indicated by the arrow ζ opposite to the rotating direction of the magnet roll 16 while a brush of the toner d is formed. The conveyed magnetic toner d is regulated to have a predetermined thickness by the doctor blade 12*a* and conveyed to the recording section W. In this case, the magnetic toner d is triboelectrified to have a negative polarity by friction between the toner particles or the toner and the circumferential surface of the development sleeve 15. The plurality of recording electrodes EL are arranged in the recording section W, as shown in FIG. 7A. The driving circuit element 18 selectively applies a recording voltage to the respective recording electrodes EL in accordance with recording data in the manner described before. In this case, referring to FIG. 7A, if one-bit recording data is "H", when the voltage of −200 V is applied to the corresponding recording electrode EL, since a bias power source 5*a* applies a bias voltage of −50 V to the counter cylindrical electrode 5, a potential difference of 150 V is formed from the cylindrical electrode 5 to the recording electrodes EL. Since the magnetic toner d charged to have a negative polarity moves to a portion where the potential is high, only the magnetic toner d on the recording electrode EL applied with the voltage of −200 V is selectively transferred to the surface of the cylindrical electrode 5 to form one black dot.

If the one-bit recording data is "L", the corresponding recording electrode EL is grounded. As a result, the potential difference between the cylindrical electrode 5 and the corresponding recording electrode EL becomes −50 V from the cylindrical electrode 5 side, and the magnetic toner d having a negative polarity is kept held by the recording electrode EL side and is not transferred.

As described above, a potential of each recording electrode EL is selectively controlled to be either −200 V or the ground potential in accordance with input recording data, and a toner recording image in accordance with the recording data is formed on the surface of the counter cylindrical electrode 5. In this case, each recording electrode EL projects from the step G, as shown in FIG. 6A, and a slit C is formed between the adjacent recording electrodes EL, thereby separating each recording electrode EL to be capable of swinging independently in its widthwise direction. In this manner, the electrode-to-electrode distance L between the upper surfaces of the recording electrodes EL and the circumferential surface of the cylindrical electrode 5 in the recording section W can be constantly maintained at a necessary minimum value. As a result, the magnetic toner d can be smoothly conveyed through the recording section W, and an inconvenience in that the magnetic toner is caused by the recording section W to become dense under pressure to fuse and deposit on the electrodes is reliably prevented. Hence, a high-resolution, high-quality toner recording image is stably formed on the circumferential surface of the cylindrical electrode 5.

Since the step G is formed on the immediately downstream side of the recording section W as shown in FIG. 4, the magnetic toner d' not subjected to image formation but remaining on the development sleeve 15 moves away from the surface of the cylindrical electrode 5 immediately after passing through the recording section W. Therefore, an inconvenience in that the toner recording image formed on the circumferential surface of the cylindrical electrode 5 in the recording section W is disturbed by mutual interference with the residual magnetic toner d' can be reliably avoided.

Furthermore, as shown in FIG. 6A, since the recording electrodes EL are exposed without coating the insulating coat 17c on it, unnecessary charges are not stored in them. As a result, a scumming caused by unnecessary charges or a voltage leakage between the recording electrodes can be prevented, and a high-resolution, high-density, high-contrast toner recording image can be stably formed.

Referring to FIG. 1, the toner recording image formed on the surface of the cylindrical electrode 5 is conveyed to the image transfer section T by the rotation of the cylindrical electrode 5 in the counterclockwise direction ' and transferred onto paper fed again by the registration roll pair 3 in synchronism with it. To adjust the density of the toner recording image, the bias voltage of the bias power source 5a need only be changed. In this case, a proper adjustment range is about 0 to −50 V, and the image density is increased as the value becomes closer to 0 V.

Referring to FIG. 2, the magnetic toner d' not transferred to the cylindrical electrode 5 but remaining in the recording section W moves to the downstream side by the rotation of the magnet roll 16 and is scraped from the surface of the development sleeve 15 by the scraping wall Sw1. The scraped toner falls onto the auger roll 14a and is mixed under agitation with magnetic toner d0 replenished from the replenishment port 11b.

The fell and returned residual magnetic toner d' is circulated by the rotation of the auger roll 14a while being mixed with the replenishing magnetic tone d0. Referring to FIG. 3, the magnetic toner circulated in the direction indicated by the broken arrow δ is vertically conveyed again by the rotational magnetic field of the magnet roll 16 extending above the longitudinal path 13b on the nonreplenishment side while being conveyed in the path 13b.

In this manner, the residual magnetic toner d' not transferred to the cylindrical electrode 5 but conveyed to the downstream side in the recording section W is scraped on the horizontal circulating path 13, smoothly returned to the upstream side under agitation through the horizontal circulating path 13, and subjected to formation of a toner recording image again. In this case, since the magnetic toner d before the vertical conveyance is conveyed under agitation along the axial direction (the widthwise direction of the toner convey path: the main scanning direction) of the development sleeve 15, the toner is constantly, uniformly supplied on the circumferential surface of the development sleeve 15 throughout in its widthwise direction. Therefore, since the magnetic toner d is constantly, uniformly carried by the surface of the development sleeve 15 throughout in its widthwise direction and conveyed to the recording section W, a high-quality recording image having a uniform image density can be stably obtained. In addition, the magnetic toner is satisfactorily triboelectrified due to the friction between the magnetic toner particles caused when the magnetic toner d is circulated in the horizontal circulating path 13 under agitation.

The second embodiment of the present invention will now be described hereinbelow. In the second embodiment, a recording section W for forming a toner recording image on the circumferential surface of a cylindrical electrode 5 is arranged on the downstream side of the toner layer thickness regulating section (described above) along the toner conveying direction ζ in the following manner.

Figure 9:
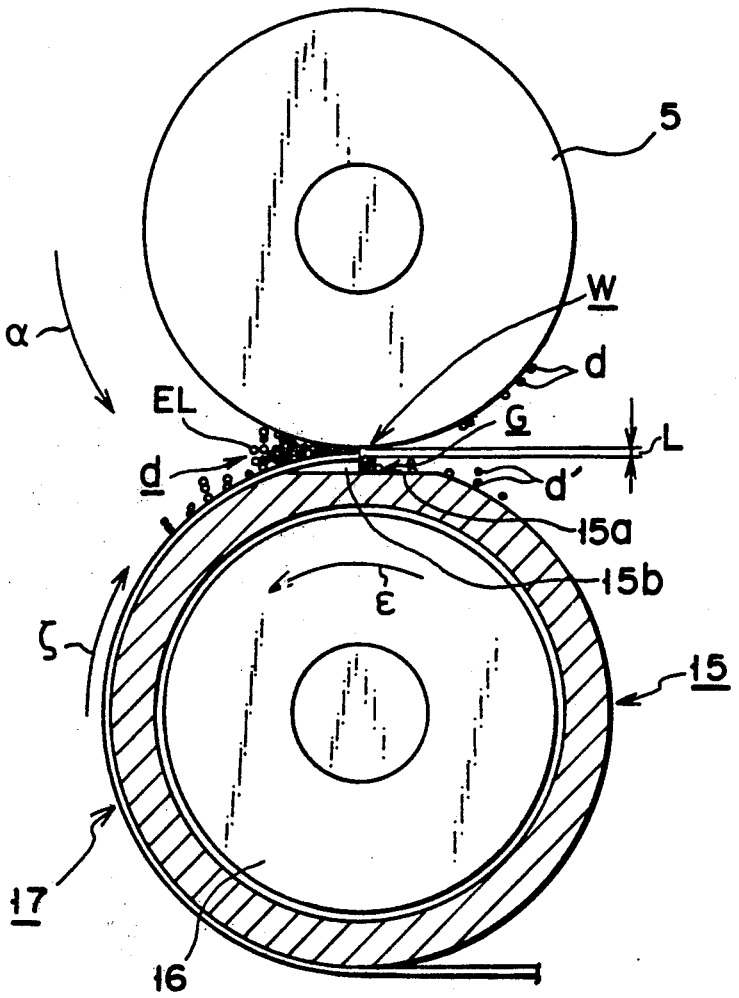
FIG. 9 is a schematic side view showing a recording section of an electrostatic recording apparatus according to the second embodiment of the present invention.

That is, as shown in FIG. 9, a portion of the circumferential surface of a development sleeve 15 close to the circumferential surface of the cylindrical electrode 5 is removed to form a flat portion 15a throughout the entire width of the development sleeve 15. A cushion member 15b consisting of an elastic material is fixed on the entire region half the flat surface 15a on the upstream side along the toner conveying direction ζ. As the material of the cushion member 15b, an elastic material having a modulus of elasticity E satisfying $$1\times10^6 \leqq E \leqq 3\times10^9\ [N/m^2]$$

can be suitably utilized. The surface of the cushion member 15b forms a circumferential surface having the same curvature as that of the development sleeve 15 so as to be continuous with it. Therefore, the downstream end portion of the surface of the cushion member 15b is closest to the circumferential surface of the cylindrical electrode 5, and a step G is formed on the immediately downstream side of this portion.

A recording electrode sheet 17 is formed on the surface of the cushion member 15b and extends to the upstream circumferential surface of the development sleeve 15. In this case, the distal end of the recording electrode sheet 17 is flush with the end face of the cushion member 15b that forms the step G. Note that the arrangement of the recording electrode sheet 17 of this embodiment is identical to that of the first embodiment and a detail description thereof is omitted.

Figure 10:
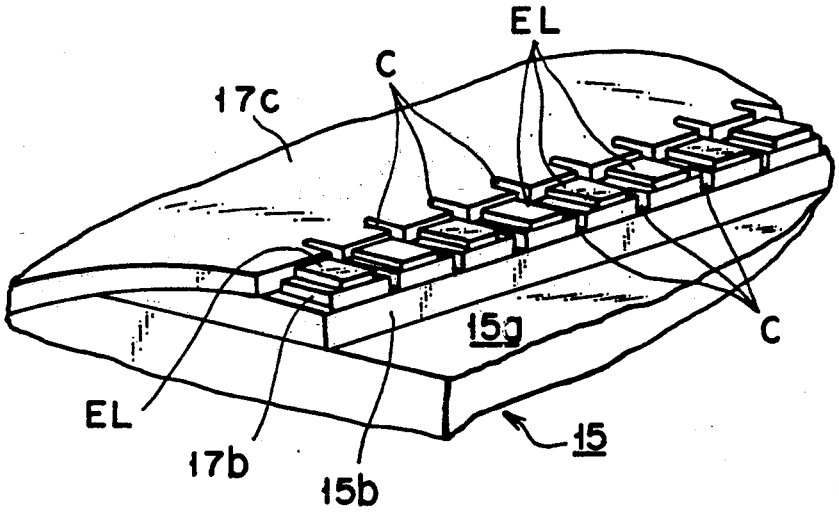
FIG. 10 is a perspective view showing recording electrodes of an image forming unit according to the second embodiment of the present invention.
Figure 11A:
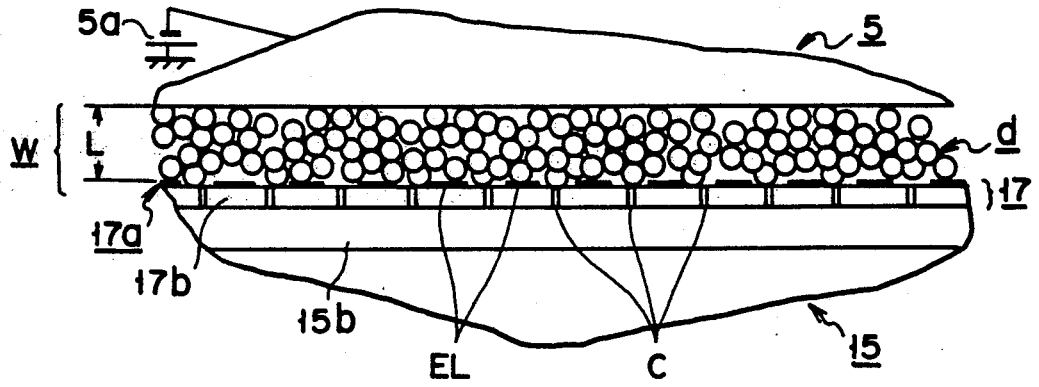
FIGS. 11A and 11B are schematic elevations for explaining an operation of the recording section according to the second embodiment.
Figure 11B:
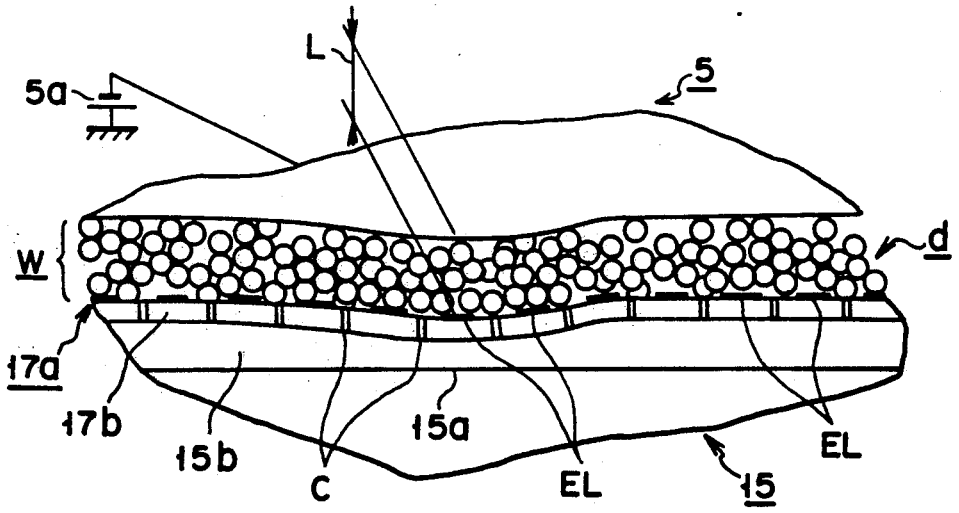

As shown in FIGS. 10 and 6B, slits C are formed in the base film 17b at portions between adjacent recording electrodes EL. Each slit C extends not only between the adjacent recording electrodes EL but also to proximal portions of the recording electrodes EL covered with an insulating coat 17c. Therefore, each recording electrode EL is separated from the adjacent recording electrodes EL on its two sides and can freely, independently swing in the direction of its thickness (vertical direction in this embodiment). When the distal end portion of the recording electrode sheet 17 having the above arrangement is formed on the cushion member 15, as shown in FIG. 10, a distance L between upper surfaces of the recording electrodes EL and the circumferential surface of the cylindrical electrode 5 can be constantly set at a predetermined necessary minimum value. The mechanism for this will be described with reference to FIGS. 11A and 11B. FIGS. 11A and 11B are schematic elevations of the recording section W seen from the downstream side of the toner conveying direction.

As shown in FIG. 11B, even if the circumferential surface of the cylindrical electrode 5 locally swings to close to the recording electrode EL side by about several μm to several tens of μnm, a portion of the cushion member 15b opposing the circumferential surface of the cylindrical electrode 5 through a magnetic toner d flexes in response to this wing and the corresponding recording electrode EL sinks, and the electrode-to-electrode distance L is kept at substantially the same as the necessary distance shown in FIG. 11A. Therefore, an inconvenience in that the magnetic toner d becomes excessively dense at the swing portion under pressure is reliably prevented. As a result, an excessive current will not flow in the dense magnetic toner to generate heat, causing magnetic toner fusing to an electrode. The magnetic toner d is smoothly conveyed in the entire width of the counter-electrode portion (the recording section W), and a high-resolution, high quality recording image can be stably formed.

In this embodiment, as shown in FIG. 8, even when a foreign substance r mixed in the magnetic toner d or a block of the magnetic toner d is conveyed to the opposite electrode portion (the recording section W), since a recording electrode EL1 that sandwiches the foreign substance r together with the cylindrical electrode 5 is separated from the adjacent recording electrodes EL on its two sides by the slits C, the recording electrode EL1 can locally largely flex independently of the adjacent recording electrodes EL and pass the foreign substance r. In this manner, an inconvenience in that a solid substance such as a foreign substance clogs in the recording section W is reliably prevented, and a high-quality recording image can be formed further stably.

Note that the present invention is not limited to the first and second embodiments but can be variously modified within its technical scope.

For example, when recording electrode lines having recording electrodes at their distal end portions are to be directly formed on a developing agent carrier member, the distal end portion of each recording electrode line need not be separated to be independently swingable, but need only project from a step.

Furthermore, although a toner having negative (−) electrification is used in the embodiment shown in FIG. 2, a toner having positive (+) electrification can also be used. In this case, a positive (+) polarity is imparted to the bias voltage to be applied to a recording electrode and an opposite electrode.

In the second embodiment shown in FIG. 11A, if the base film 17b for carrying the recording electrodes EL is made of a material having a high elasticity, the recording electrodes EL can be caused to swing in response to a swing of an opposite electrode with a better response. In this case, if the base film 17b has a required elasticity, the cushion member 15b can be omitted.

As has been described above in detail, according to the present invention, a plurality of recording electrodes are arranged on a surface of a developing agent carrier member serving as a developing agent convey path at a small pitch, are separated so that they can swing independently from each other, and are cantilevered or supported by an elastic material. Therefore, the recording electrodes flexibly swing in response to a swing of an opposite electrode, and an electrode-to-electrode distance between the recording electrode and the opposite electrode can be constantly kept at a predetermined necessary minimum value. As a result, an inconvenience in that the developing agent becomes dense under pressure between the electrodes to decrease its electrical resistance, and an excessive current flows to generate heat, is prevented. A problem in that the developing agent fuses due to the heat and pressure as it becomes dense between electrodes, thus depositing on the electrodes, is eliminated. Even if a foreign substance and the like is conveyed between the electrodes, a corresponding recording electrode largely flexes independently to pass it, and a smooth flow of the developing agent between the electrodes can be stably secured. In addition, since this recording apparatus is of a non-contact recording type, the recording electrodes will not wear out. Hence, the durability of the recording head is improved, the developing agent is constantly smoothly conveyed between the electrodes that are kept at a predetermined gap from each other, and a high-resolution, high-quality recording image can be stably formed over a long period of time.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An electrostatic recording apparatus comprising:

developing agent carrier member having a surface and arranged along a predetermined developing agent convey path;

developing agent conveying means for conveying a developing agent along said surface of said developing agent carrier member;

a plurality of recording electrodes arranged on said surface of said developing agent carrier member at a predetermined pitch;

an opposite electrode arranged to oppose said plurality of recording electrodes at a predetermined gap;

voltage applying means for applying a voltage corresponding to recording information to each of said plurality of recording electrodes to selectively transfer the developing agent, which is conveyed along said surface of said developing agent carrier member, to said opposite electrode, thereby forming a recording image corresponding to the recording information on said opposite electrode;

said developing agent carrier member having a step at a portion on said surface thereof shifted from a position closest to said opposite electrode to an upstream side of a developing agent convey direction, at least distal end portions of said plurality of recording electrodes project from said step toward said closest position to form projections, said projections being swingable in a direction toward and away from said opposite electrode during transfer of the developing agent from said surface to said opposite electrode to maintain said gap between said recording and opposite electrodes constant.

2. An apparatus according to claim 1, further including an elastic portion on said surface of said developing agent carrier member in order to support at least said separate projections.

3. An apparatus according to claim 1, wherein said elastic portion is constituted on an elastic material having a modulus of elasticity E satisfying:

$$1\times10^6 \leqq E \leqq 3\times10^9\ [N/m^2].$$

4. An electrostatic recording apparatus comprising:

developing agent carrier member having a surface and arranged along a predetermined developing agent convey path;

developing agent conveying means for conveying a developing agent along said surface of said developing agent carrier member;

a plurality of recording electrodes arranged on said surface of said developing agent carrier member at a predetermined pitch;

an opposite electrode arranged to oppose said plurality of recording electrodes at a predetermined gap; and voltage applying means for applying a voltage corresponding to recording information to each of said plurality of recording electrodes to selectively transfer the developing agent, which is conveyed along said surface of said developing agent carrier member, to said opposite electrode, thereby forming a recording image corresponding to the recording information on said opposite electrode;

wherein said developing agent carrier member has a step at a portion on said surface thereof shifted from a position closest to said opposite electrode to an upstream side of a developing agent convey direction, at least distal end portions of said plurality of recording electrodes project from said step toward said closest position to form projections, and said projections being swingable in a direction of approaching or going away from said opposite electrode, said projections comprising projections separate from each other and being swingable independently from each other.

5. An apparatus according to claim 4 wherein said opposite electrode has uneven surface portions, said projections being swingable to maintain said gap constant between said recording and opposite electrodes, including along said uneven surface portions of said opposite electrode.

6. An apparatus according to claim 1, wherein said projections comprise projections separate from each other, and said separate projections are swingable independently from each other.

7. An apparatus according to claim 1, further including an elastic portion on said surface of said developing agent carrier member in order to support at least said separate projections.

8. An apparatus according to claim 7, wherein said elastic portion is constituted of an elastic material having a modulus of elasticity E satisfying:

$$1\times10^6 \leqq E \leqq 3\times10^9\ [N/m^2].$$

9. An apparatus according to claim 1 wherein said opposite electrode has uneven surface portions, said projections being swingable to maintain said gap constant between said recording and opposite electrodes, including along said uneven surface portions of said opposite electrode.

* * * * *